US005638786A

United States Patent [19]

Gimby

[11] Patent Number: 5,638,786

[45] Date of Patent: Jun. 17, 1997

[54] SELF-CLEANING AIR FILTER FOR A FUEL VAPOR RECOVERY SYSTEM

[75] Inventor: David Robert Gimby, Livonia, Mich.

[73] Assignee: Ford Motor Company, Dearborn, Mich.

[21] Appl. No.: 698,703

[22] Filed: Aug. 16, 1996

[51] Int. Cl.[6] ..... F02B 77/00

[52] U.S. Cl. ..... 123/198 E; 55/296; 55/300

[58] Field of Search ..... 123/198 E; 55/295, 55/296, 300

[56] References Cited

U.S. PATENT DOCUMENTS

| | | | |
|---|---|---|---|
| 3,616,914 | 11/1971 | Reid | 210/107 |
| 3,670,478 | 6/1972 | Welsh et al. | 55/242 |
| 3,683,593 | 8/1972 | Kent | 55/91 |
| 3,734,295 | 5/1973 | Smith et al. | 210/278 |
| 3,855,976 | 12/1974 | Notaras et al. | 123/41.62 |
| 4,039,452 | 8/1977 | Fernandez | 210/106 |
| 4,120,527 | 10/1978 | Lawrence | 296/28 C |
| 4,514,193 | 4/1985 | Booth | 55/290 |
| 4,591,437 | 5/1986 | Emryd et al. | 210/265 |
| 5,332,499 | 7/1994 | Spencer | 210/396 |
| 5,443,726 | 8/1995 | Steiner et al. | 210/393 |
| 5,520,028 | 5/1996 | Kim et al. | 210/411 |

*Primary Examiner*—Noah P. Kamen
*Attorney, Agent, or Firm*—Neil P. Ferraro

[57] ABSTRACT

A self-cleaning air filter for a vehicle fuel vapor recovery system includes a filter cleaning member disposed within the filter housing to clean the filter element. The filter cleaning member collides with the filter element in response to acceleration imparted to the housing by the vehicle to cause matter occluding the filter element to dislodge therefrom.

20 Claims, 4 Drawing Sheets

SELF-CLEANING AIR FILTER FOR A FUEL VAPOR RECOVERY SYSTEM

FIELD OF THE INVENTION

The present invention relates to an air filter for a fuel vapor recovery system in an automotive vehicle, and, more particularly, to a self-cleaning air filter.

BACKGROUND OF THE INVENTION

Conventional fuel vapor recovery systems used in automotive vehicles typically include a carbon canister used to recover excess fuel vapor generated in the fuel tank. Activated carbon in the carbon canister adsorbs the fuel vapor and temporarily retains the vapor until the canister is purged. When the engine is operating at a predetermined operating state, the fuel vapor adsorbed by the activated carbon is desorbed by introducing air to the canister. The fuel vapor thus desorbed is fed to the engine for utilization in combustion.

Typically, the air used to purge the carbon canister is first filtered by an air filter. Generally, prior art air filters for carbon canisters typically comprise a fiber filter in a housing, with the filter assembly being located in an area on the vehicle that may be exposed to dust, dirt, grime, road salt, and other matter. The inventor of the present invention has found certain disadvantages with these air filters. For example, the filters tend to become prematurely occluded with foreign matter. Thus, these filters must be replaced at frequent maintenance intervals.

Self-cleaning air filters exist, however they generally utilize either a separate air source or a portion of redirected inlet air so as to flush the air filter element by forcing air through the outlet side of the filter element. This generally requires either a separate air source or extensive ducting of the inlet air to redirect the airflow. Other self-cleaning air filters using a wiper may not clean the entire surface of the filter element. Not only are these self-cleaning filters more complex resulting in high production and maintenance costs, but, because the wiper is in constant contact with the filter element, the fibers of the filter element may become frayed.

SUMMARY OF THE INVENTION

An object of the present invention is to provide a low cost, low maintenance self-cleaning air filter for a fuel vapor recovery system of a vehicle. This object is achieved and disadvantages of prior art approaches overcome by providing a novel self-cleaning air filter for a vehicle. In one particular aspect of the invention, the self-cleaning air filter includes a housing having an inlet and an outlet, and a filter element disposed within the housing to filter air flowing from the inlet to the outlet. At least one filter cleaning member is disposed within the housing. The filter cleaning member collides with the filter element when the vehicle is being operated so as to cause matter occluding the filter element to dislodge therefrom.

In a preferred embodiment, the filter cleaning member includes at least one loose filter cleaning particle disposed within the housing. As the vehicle is operated, the loose filter cleaning particle collides with the filter cleaning element to dislodge matter occluding the filter element.

In another embodiment, the filter housing has a tortuous inlet section which reduces the amount of matter entering the filter. The tortuous inlet section may be provided by a baffle section in the housing.

Some prior art filters that become occluded with matter may cause the fuel vapor recovery system to malfunction. To reduce the likelihood of a system malfunction, in a preferred embodiment, the filter of the present invention includes an air by-pass valve to allow airflow between the inlet and outlet if the filter element were to become temporarily occluded.

An advantage of the present invention is that a low cost, low maintenance self-cleaning filter is provided.

Another advantage of the present invention is that a substantial portion of the filter element is cleaned.

Still another advantage of the present invention is that a filter having a high useful life is provided.

Yet another advantage of the present invention is that the inlet airflow into the filter flows through a tortuous airflow path so as to increase the life of the filter element by reducing the amount of matter entering the filter.

Another advantage of the present invention is that an air by-pass valve is provided to reduce the possibility of fuel vapor recovery system malfunction.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Figure 1:
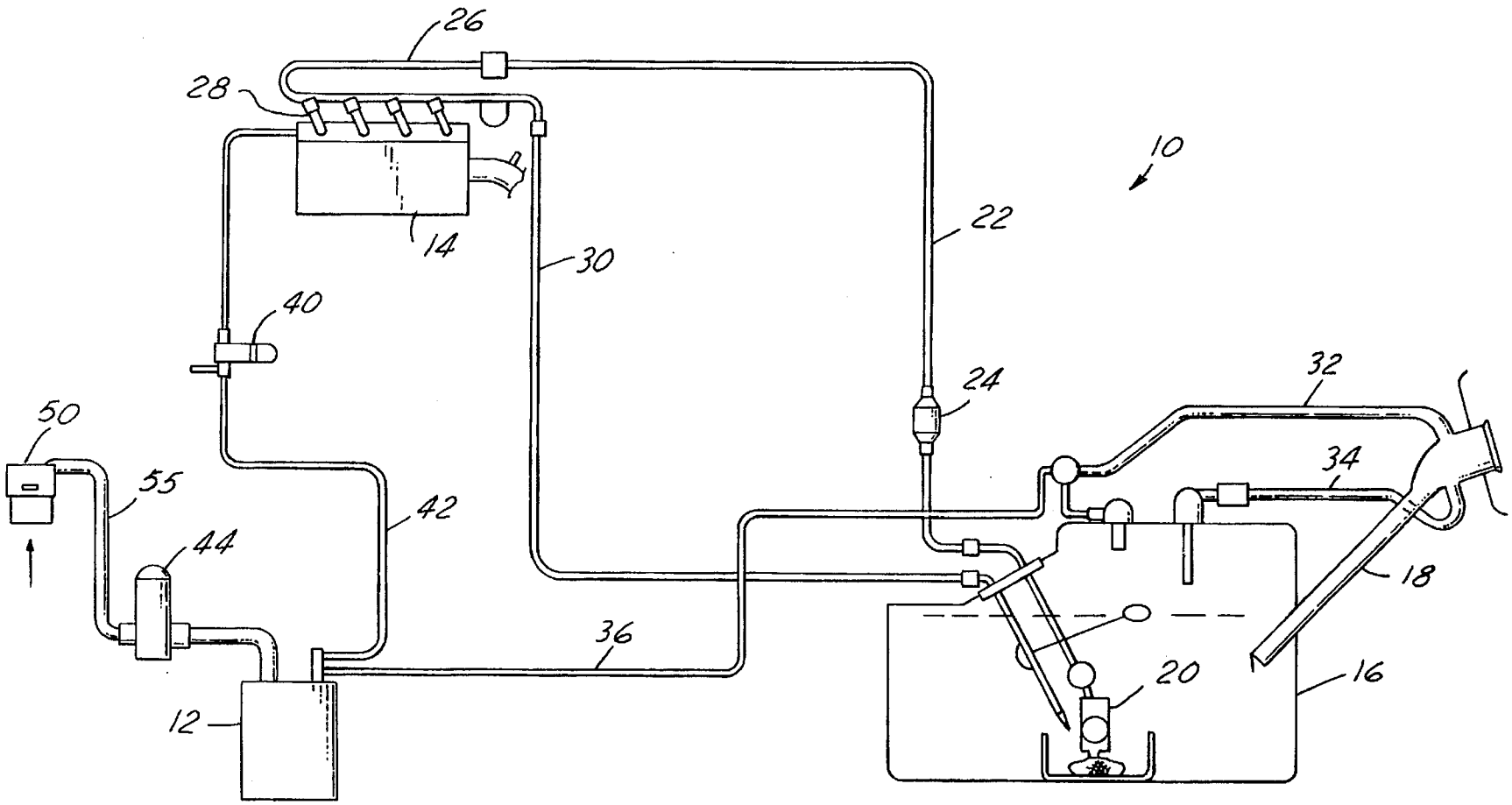
FIG. 1 is a schematic view of an automotive powerplant having a fuel vapor recovery system utilizing a self-cleaning filter according to the present invention.

Fuel vapor recovery system 10, shown in FIG. 1, includes carbon canister 12 attached to both internal combustion engine 14 and fuel tank 16. As is well known to those skilled in the art, fuel enters fuel tank 16 through fuel filler tube 18 and is pumped to engine 14 by electric fuel pump 20 through fuel line 22 and fuel filter 24. Fuel is then distributed by fuel rail 26 to a plurality of fuel injectors 28. Excess fuel not utilized by engine 14 is returned to fuel tank 16 through fuel return line 30. Those skilled in the art will recognize in view of this disclosure that a returnless fuel system (having no return line 30) may be used as well.

A plurality of vent lines in fuel vapor recovery system 10 is used to vent fuel vapor from fuel tank 16. Thus, as fuel enters fuel tank 16 through fuel filler tube 18, any fuel vapor exiting the fuel tank is captured by vent lines 32, 34 and transported to carbon canister 12 through fuel recovery line 36.

Carbon canister 12 contains activated carbon which is used to adsorb any fuel vapor entering therein. Carbon canister 12 is filled with activated carbon which is used to adsorb the fuel vapor. Periodically, the fuel vapor accumulated or adsorbed by the carbon in the carbon canister must be purged so as to refresh the carbon canister to enable it to adsorb additional vapor. Accordingly, this purged vapor is utilized by internal combustion engine 14. An engine controller (not shown) actuates canister purge valve 40 to allow vapor in carbon canister 12 to flow through vapor purge line 42. The engine controller then modifies the fuel delivery to fuel injectors 28 to accommodate the additional fuel source from the purged fuel vapor. In order to desorb the fuel vapor stored in carbon canister 12, air is introduced into carbon canister 12 through canister vent valve 44, which is actuated by the controller (not shown). Typically, an air filter is placed upstream of carbon canister 12 to introduce filtered air into carbon canister 12. The air filter is generally located on the vehicle (not shown) in an area exposed to dust, dirt, grime, road salts and other matter. Thus, according to the present invention, self-cleaning air filter 50 is used.

Figure 2:
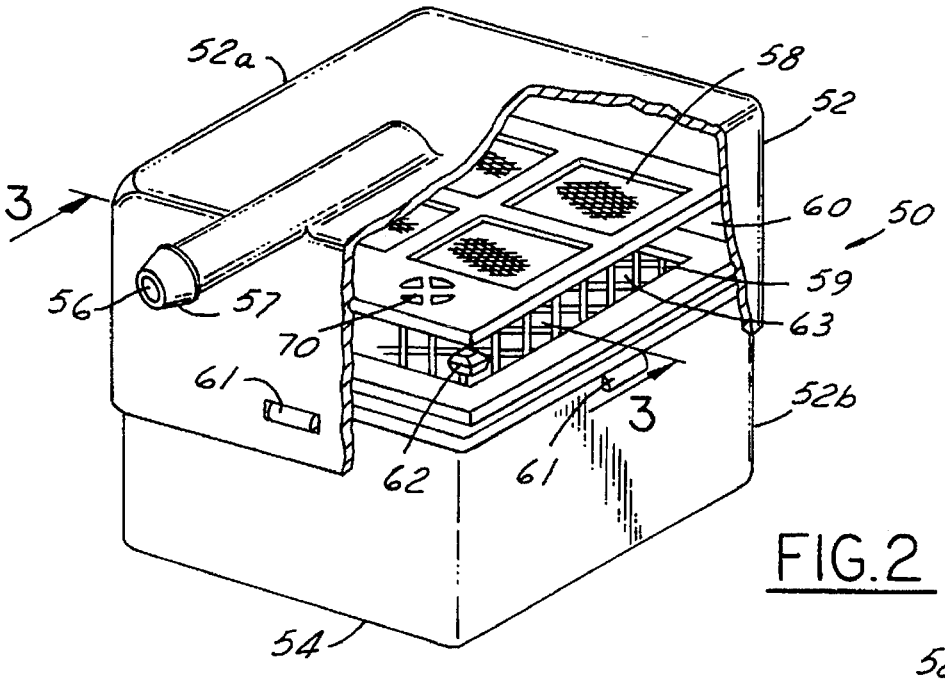
FIG. 2 is a perspective view of a self-cleaning filter according to the present invention.
Figure 4:
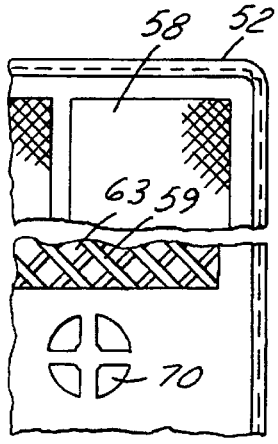
FIGS. 3 and 4 are cross-sectional views of a self-cleaning filter according to the present invention; and, FIGS. 5 through 9 are alternative embodiments of a self-cleaning filter according to the present invention.
Figure 3:
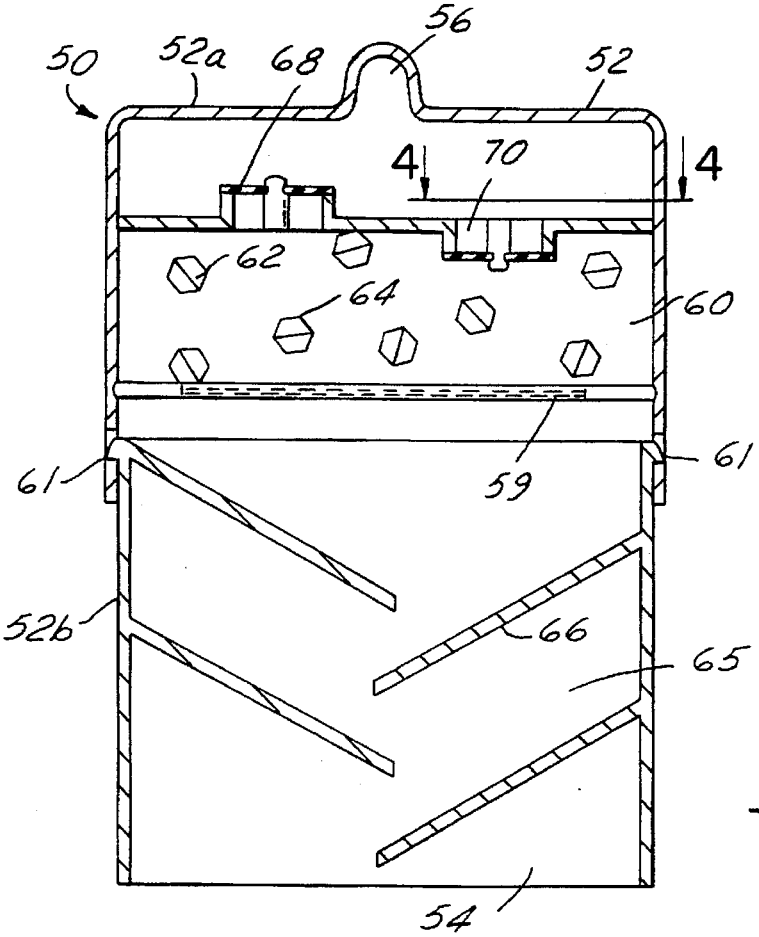

Turning now to FIGS. 2–4, self-cleaning air filter 50 is shown. Filter 50 includes housing 52 having an inlet 54 and outlet 56. Outlet 56 is formed with nipple 57 for ready attachment to canister vent line 55 (FIG. 1). Filter element 58 is disposed within housing 52 for filtering the air flowing from inlet 54. Filter element 58 may be a fiber filter or a fine-mesh screen or any other filter element known to those skilled in the art and suggested by this disclosure. Filter screen 59 is disposed in housing 52 beneath filter element 58 to define cavity 60. Housing 52 has an upper portion **52*a* and a bottom portion 52*b*. Upper portion 52*a* may be assembled to lower portion 52*b* by, for example, latches 61. However, those skilled in the art will recognize in view of this disclosure that upper portion 52*a* may be assembled to lower portion 52*b*** by any suitable means.

According to the present invention, at least one filter cleaning member 62 is located within cavity 60. As the vehicle is being operated, the vibration due to either engine 14 or to reactions of the vehicle itself as it moves along a road, causes filter cleaning element 62 to vibrate or bounce within housing cavity 60. That is, filter cleaning member 62 collides with filter element 58 in response to acceleration imparted to housing 52 by the vehicle. This movement causes filter cleaning member 62 to collide with the inlet side of filter element 58 so as to cause matter occluding the filter element 58 to dislodge therefrom. Those skilled in the art will recognize in view of this disclosure that filter cleaning 62 member may be positioned between filter element 58 and outlet 56 so as to collide with the outlet side of filter element 58. Filter screen 59 has perforations 63 large enough to allow the matter to fall through inlet 54, yet small enough to retain filter cleaning member 62 within cavity 60.

In the embodiment described with reference to FIGS. 2–4, filter cleaning member 62 comprises a plurality of loose particles disposed within the housing. Loose particles 62 may be generally spherically shaped, such as in the case of a ball-bearing or, in a preferred embodiment, loose particles 62 may have a rough surface to provide at least one projection 64 on the outer surface thereof to enhance dislodging of the occluded matter from filter element 58. In the example shown in FIGS. 2–4, loose particles 62 have a hexagonally shaped cross-section.

Referring now in particular to FIG. 3, housing 52 defines a tortuous airflow path between inlet 54 and outlet 56 so that the amount of matter entering filter 50 is reduced. This tortuous airflow path is formed by baffle section 65 comprising a plurality of angularly (inwardly and downwardly as shown in FIG. 3) disposed vanes 66 within housing 52. This baffle section funnels the dislodged matter from filter element 58 out toward inlet 54. Those skilled in the art will recognize in view of this disclosure that vanes 66 may extend substantially perpendicular to housing 52 so as to produce a tortuous path between inlet 54 and filter member 57.

FIGS. 3 and 4 show filter 50 having at least one air by-pass valve disposed between inlet 54 and outlet 56. By-pass valve 68 allows the airflow to by-pass filter element 58 and flow directly from inlet 54 to outlet 56 when filter element 58 is temporarily occluded. Thus, unfiltered air is temporarily permitted into canister 12 of fuel vapor recovery system 10 during purging of canister 12. In addition, by-pass valve 70 may be provided to allow air to by-pass filter element 58 and flow directly from outlet 56 to inlet 54 when filter element 58 is temporarily occluded. Thus, air is permitted to flow out of fuel recovery system 10 during vehicle refueling. If by-pass valves 68, 70 were not provided, an occluded filter element 58 may prevent purging of canister 12 (in the case of by-pass valve 68), or, prevent refueling of fuel tank 16 due to an air-lock (in the case of by-pass valve 70). Each by-pass valve is biased closed and is set to open when the restriction through the occluded filter element exceeds a predetermined value.

Figure 7:
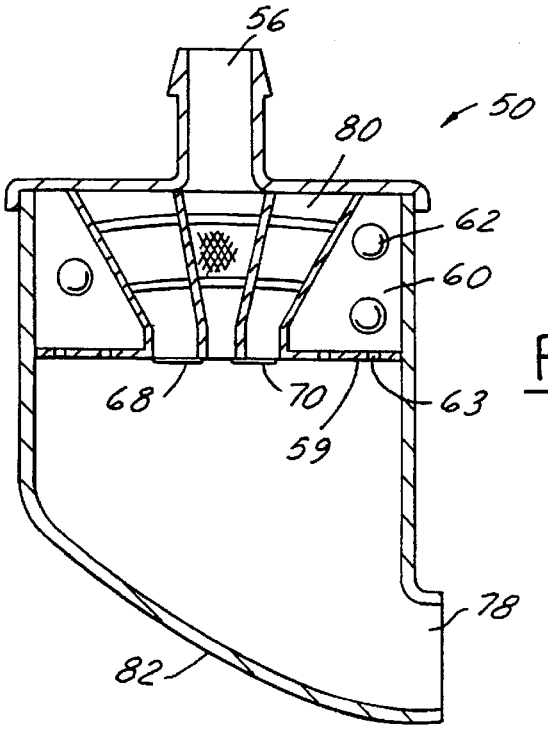
Figure 6:
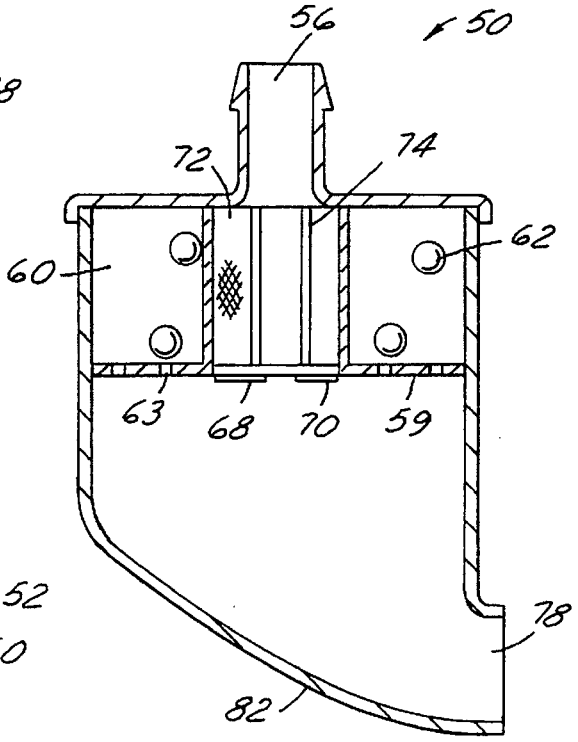
Figure 5:
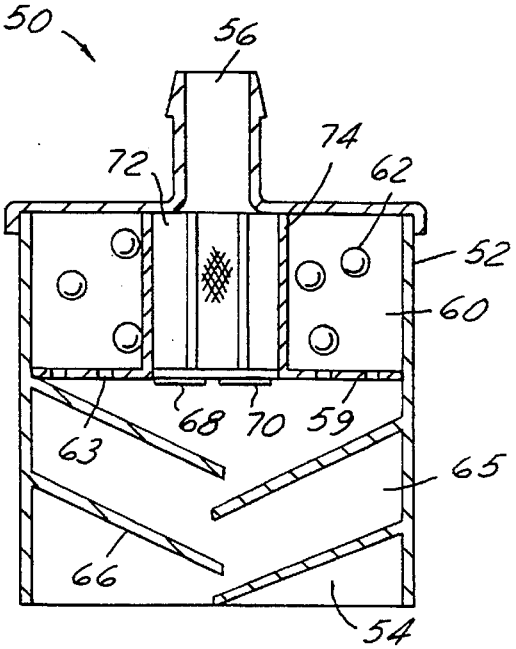

Referring now to FIGS. 5–7, alternative embodiments according to the present invention, will be described where like elements will be referred to with like reference numerals. In particular, referring to FIG. 5, rather than the flat filter element 58 shown in FIGS. 2–4, a cylindrical filter element 72 is shown disposed in housing 52. In addition, a plurality of webs 74 give structural support to filter element 72. According to the present invention, filter cleaning members 62, shown here as generally spherically shaped loose particles, are housed in cavity 60 defined by housing 52, filter element 72 and screen 58. Thus, when the vehicle is being operated, filter cleaning members 62 collide with filter element 74 to dislodge any occluded matter therefrom. In addition, housing 52 may be supplied with baffle section 65 between inlet 54 and filter element 74. As discussed with reference to FIG. 3, baffle section 65 is formed by a plurality of angularly disposed vanes 66. Further, filter 50, shown in FIG. 5, includes bypass valves 68, 70 for allowing direct airflow between inlet 54 and outlet 56, as described with reference to FIGS. 2–4.

FIG. 6 shows self-cleaning filter 50 having an inlet 78 formed in a side wall of housing 52. Thus, rather than providing baffle section 65 in housing 52, inlet 78, formed in the side of housing 52, provides the tortuous airflow path between inlet 78 and outlet 56 to reduce matter entering self-cleaning filter 50. In addition, according to the present invention, self-cleaning filter 50 is positioned on the vehicle such that inlet 78 is directed primarily in a direction opposite to that of vehicle travel to further inhibit matter from entering filter 50.

In the embodiment shown in FIG. 7, filter element 80 is formed as an inverted truncated cone. According to the present invention, this inverted cone shaped filter element 80 enhances the dislodging of matter occluding filter element 80. That is, when filter cleaning members 62 collide with filter element 80, gravity enhances the dislodging of matter occluding filter element 80. In addition, in this embodiment, filter cleaning members 62 collide with filter element 80 with greater frequency and force.

Figure 8:
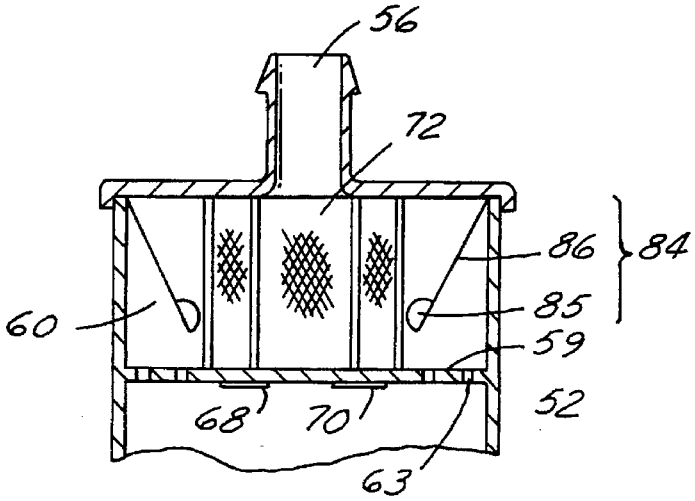

Referring now to the embodiment shown in FIG. 8, filter cleaning members 84 each comprise mass 85 attach to spring 86 such as a leaf spring. Spring 86, in turn is attached to housing 52. As the vehicle is operated, mass 85 oscillates, due to the action of spring 86, so as to collide with filter element 72 to dislodge any matter therefrom. Of course, as discussed with reference to FIGS. 5–7, housing 52 may be formed with either baffle section 65 or angular bottom 82 with inlet 78 formed in the side wall of housing 52.

Figure 9:
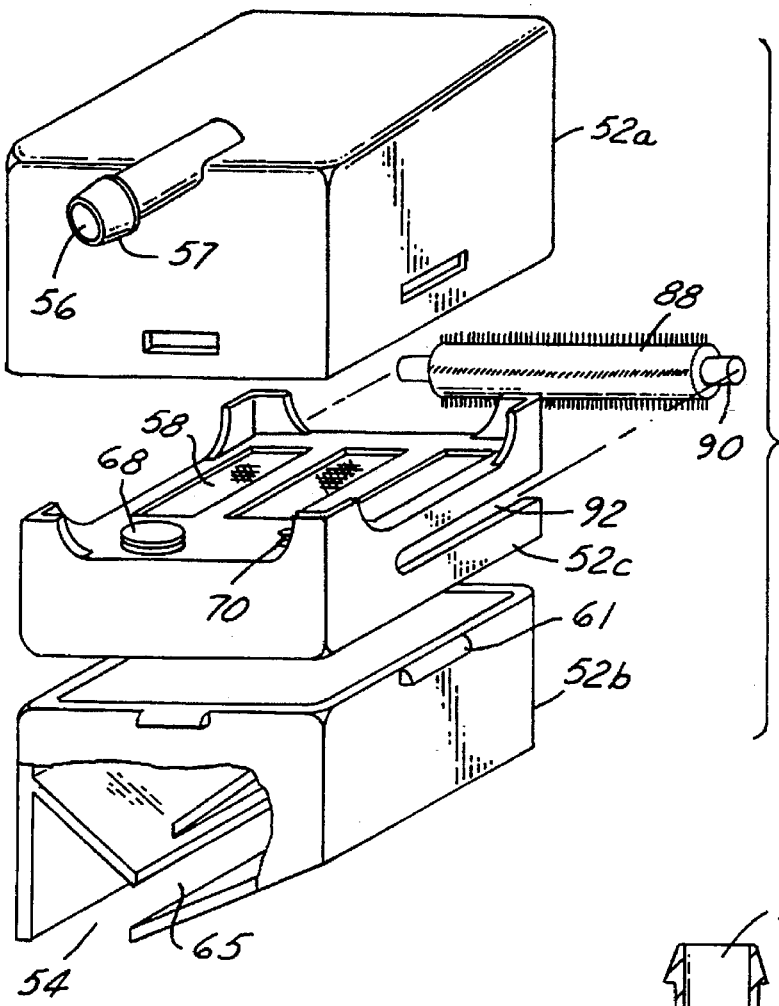

In the embodiment of FIG. 9, the filter cleaning member comprises roller brush 88. Housing portion **52*c*, which is disposed between housing portion 52***a* and 52*b*, is formed with channel or track 92 (only one side of which is shown in this view) to receive end 90 of roller brush 88. Thus, roller brush 88 is free to move in channel 92 as the vehicle accelerates or decelerates. This movement causes roller brush 88 to clean filter element 58. For increased cleaning effectiveness, roller brush 88 may be weighted relative to filter 50. Those skilled in the art will recognize in view of this disclosure that filter 50 may be positioned in the vehicle such that channel 92 is in a vertical direction. Thus, when the vehicle oscillates due to the excitation of the road surface, roller brush 88 moves within channel 92 to clean filter element 58. To further enhance the cleaning action loose particles 62 (not shown) may be provided between filter element 58 and outlet 56 so as to clean the outlet side of filter element 58. In addition, filter 50 may also include baffle section 65 and by-pass valves 68, 70, as previously described.

While the best mode for carrying out the invention has been described in detail, those skilled in the art in which this invention relates will recognize various alternative designs and embodiments, including those mentioned above, in practicing in the invention that has been defined by the following claims. Indeed, those skilled in the art will appreciate that the invention described herein may be utilized in systems other than a fuel vapor recovery system.

I claim:

1. A self-cleaning air filter for a vehicle comprising:

a housing having an inlet and an outlet;

a filter element disposed within said housing for filtering air flowing from said inlet to said outlet; and, at least one filter cleaning member disposed within said housing, with said member colliding with said filter element when the vehicle is being operated so as to cause matter which would otherwise occlude said filter element to dislodge therefrom.

2. A self-cleaning air filter according to claim 1 wherein said filter cleaning member comprises at least one loose filter cleaning particle disposed within said housing, with said loose filter cleaning particle colliding with said filter element when said particle is excited by acceleration imparted to said housing by the vehicle.

3. A self-cleaning air filter according to claim 2 wherein said filter is spaced from said housing so as to define a cavity between said housing and said filter, with said loose particle being disposed within said cavity.

4. A self-cleaning air filter according to claim 3 further comprising a screen disposed in said housing between said inlet and said outlet, with said screen defining a boundary of said cavity and having perforations smaller than the size of said loose particle so as to contain said loose particle within said cavity.

5. A self-cleaning air filter according to claim 2 wherein said loose particle is generally spherically shaped.

6. A self-cleaning air filter according to claim 2 wherein said loose particle has at least one projection on an outer surface thereof for enhancing dislodging of said matter occluding said filter element.

7. A self-cleaning air filter according to claim 1 wherein said filter cleaning member comprises a spring element attached to said housing and having a mass disposed on one end thereof, with said spring element causing said mass to oscillate, thereby colliding with said filter element when said particle is excited by acceleration imparted to said housing by the vehicle.

8. A self-cleaning air filter according to claim 1 wherein said filter cleaning member collides with the inlet side of said filter member.

9. A self-cleaning air filter according to claim 1 wherein said housing defines a tortuous airflow path between said inlet and the inlet of said filter element so as to reduce the amount of matter entering said filter.

10. A self-cleaning air filter according to claim 9 further comprising a baffle section disposed between said inlet and said filter element, with said baffle section defining said tortuous path.

11. A self-cleaning air filter according to claim 10 wherein said baffle section comprises a plurality of vanes angularly disposed relative to said housing, with said vanes funneling matter toward said inlet.

12. A self-cleaning air filter according to claim 1 further comprising an air by-pass valve disposed between said inlet and said outlet for allowing airflow to by-pass said filter element and flow directly between said inlet and said outlet, with said by-pass valve opening to allow said direct communication when said filter element is occluded.

13. A self-cleaning air filter according to claim 1 wherein said filter element is generally cylindrical in shape.

14. A self-cleaning air filter according to claim 1 wherein said filter element is generally conical in shape.

15. A self-cleaning air filter for a vehicle comprising:

a housing having an inlet and an outlet;

a filter element disposed within said housing for filtering air flowing from said inlet to said outlet; and, a roller brush disposed within a channel formed in said housing, with said brush moving within said channel in response to acceleration imparted to said housing by the vehicle such that said roller brush rolls in said channel and contacts said filter element so as to cause filtered matter which would otherwise occlude said filter element to dislodge therefrom.

16. A self-cleaning filter according to claim 15 further comprising an air by-pass valve disposed between said inlet and said outlet for allowing airflow to by-pass said filter element and flow directly between said inlet and said outlet, with said by-pass valve opening to allow direct communication when said filter element is occluded.

17. A fuel vapor recovery system for a vehicle having a fuel tank and an internal combustion engine, with the fuel recovery system comprising:

a carbon canister communicating with the fuel tank and the internal combustion engine, with said carbon canister recovering fuel vapor from the fuel tank for reuse by the engine; and, a self-cleaning air filter communicating with said canister to permit filtered air into said canister, with said filter comprising:

a housing having an inlet communicating with said canister and an outlet;

a filter element disposed within said housing for filtering air flowing from said inlet to said outlet; and, at least one filter cleaning member disposed within said housing, with said member colliding with said filter element in response to acceleration imparted to said housing by the vehicle so as to cause filtered matter which would otherwise occlude said filter element to dislodge therefrom.

18. A fuel vapor recovery system according to claim 17 wherein said self-cleaning air filter further comprises an air by-pass valve disposed between said inlet and said outlet for allowing airflow to by-pass said filter element and flow directly between said inlet and said outlet when said filter element is occluded, with said by-pass valve opening to allow direct communication when said filter element is occluded.

19. A fuel vapor recovery system according to claim 17 wherein said housing defines a tortuous airflow path between said inlet and the inlet of said filter element so as to reduce the amount of matter entering said filter element.

20. A fuel vapor recovery system according to claim 17 wherein said filter cleaning member comprises at least one loose filter cleaning particle disposed within said housing, with said loose filter cleaning particle colliding with said filter element.

* * * * *